United States Patent [19]

Murata et al.

[11] Patent Number: 5,069,123

[45] Date of Patent: Dec. 3, 1991

[54] PRINT WHEEL PRINTER HAVING SEPARABLE TRIGGER CASING AND MAIN HOUSING

[75] Inventors: Sadao Murata; Yasuhiro Harada; Susumu Hama, all of Suwa, Japan

[73] Assignee: Seiko Epson Corporation, Japan

[21] Appl. No.: 509,482

[22] Filed: Apr. 16, 1990

[30] Foreign Application Priority Data

| | | | |
|---|---|---|---|
| Apr. 17, 1989 | [JP] | Japan | 1-44813[U] |
| Apr. 17, 1989 | [JP] | Japan | 1-97175 |
| Apr. 25, 1989 | [JP] | Japan | 1-48455[U] |
| Apr. 25, 1989 | [JP] | Japan | 1-48456[U] |

[51] Int. Cl.[5] ..... B41J 1/32

[52] U.S. Cl. ..... 101/93.21; 101/95; 101/99; 101/110

[58] Field of Search ..... 101/110, 99, 96, 95, 101/93.21, 93.22, 93.28–93.31, 93.18, 93.26, 106–108, 85–89, 75

[56] References Cited

U.S. PATENT DOCUMENTS

| | | | |
|---|---|---|---|
| 4,033,256 | 7/1977 | Hanaoka | 101/99 |
| 4,104,967 | 8/1978 | Okabe et al. | 101/99 |
| 4,142,463 | 3/1979 | Mitsui et al. | 101/99 |
| 4,164,181 | 8/1979 | Hanaoka | 101/99 |
| 4,244,290 | 1/1981 | Tamai et al. | 101/99 |
| 4,452,137 | 6/1984 | Takeuchi et al. | 101/93.22 |
| 4,804,282 | 2/1989 | Hori | 101/99 X |

*Primary Examiner*—Edgar S. Burr
*Assistant Examiner*—C. A. Bennett
*Attorney, Agent, or Firm*—W. Douglas Carothers, Jr.

[57] ABSTRACT

A print wheel printer includes a trigger unit casing and a main housing frame, a plurality of print wheels rotatably mounted on a print wheel shaft and having a corresponding ratchet wheel secured to one side of each print wheel. A plurality of rotatably mounted selective pawls are supported on the trigger unit casing for stopping the rotation of the print wheels at selected print wheel engagement positions wherein a corresponding pawl is rotated into position to engage a corresponding print wheel ratchet wheel. A rotatable reset lever is also mounted on the trigger unit casing for the purpose of returning the selective pawls to a print wheel disengagement position. The selective pawls and the reset lever are both supported on the trigger unit casing in a prealigned relationship and support means are provided on the main housing frame for supporting the set of print wheels. Interengagement means on the trigger unit casing and the main housing frame provide for securing the casing onto the main housing frame whereby positional alignment of the casing selective pawls relative to the print wheel ratchet wheels is achieved without need for any further after-assembly adjustment.

5 Claims, 6 Drawing Sheets

2
2B
2A
2B
2A
7
8
8D
6E
3
1C
1
1F
1E
1H
1G
8C
8D
8E
6
9
10A
10

PRINT WHEEL PRINTER HAVING SEPARABLE TRIGGER CASING AND MAIN HOUSING

BACKGROUND OF THE INVENTION

This invention relates generally to a print wheel printer and more particularly to a printer wherein printing is performed by selection of corresponding symbols or characters on rotated print wheels by utilizing a plurality of independent and operatively selective pawls.

A print wheel printer generally comprises a plurality of print wheels which are secured to corresponding ratchet wheels, a plurality of selective pawls which stop the rotation of print wheels at selective rotational positions by engaging corresponding notches of the ratchet wheels, a plurality of electromagnetic mechanisms which rotate selected pawls to bring them into selective engagement positions with corresponding ratchet wheels, a reset lever for collectively returning all of the pawls from a print wheel engaging position to a print wheel disengaging position and a reset cam changing the positional relationship of the reset lever relative to the pawls.

As it is disclosed in Japan Laid Open Patent 144521/75, the positioning members for spatially positioning the print wheels along the print wheel shaft and the separate construction of the selective pawls on the main housing frame of the printer result in many different steps necessary for assembling together these many printer parts. Further, since positioning of these parts are determined indirectly relative to the main housing frame of the printer due to their support relative to the housing, as well as relative positional aberrations due to the lack of precision of the manufactured printer parts and the required assembly of many different parts involved, render it always necessary to perform fine adjustments after the assembly of the printer parts.

Also, since the reset lever in these printers is fixed on a trigger unit casing via a support shaft, it is necessary to disengage the trigger unit from the main housing frame each time when the reset lever is to be removed and replaced onto to trigger unit casing.

It is an object of the present invention to provide a print wheel printer wherein assembly of a plurality of parts which perform functions in connection with the operation of the print wheels is performed easily and with high precision.

It is another object of this invention to provide a simpler and more precise positioning of the print wheels of a print wheel printer.

It is still another objective of this invention to render it possible to remove and reposition a reset lever while the trigger unit casing remains secured to the main housing frame of the print wheel printer.

SUMMARY OF THE INVENTION

According to this invention, a print wheel printer includes a trigger unit casing and a main housing frame, a plurality of print wheels rotatably mounted on a print wheel shaft and having a corresponding ratchet wheel secured to one side of each print wheel. A plurality of rotatably mounted selective pawls are supported on the trigger unit casing for stopping the rotation of the print wheels at selected print wheel engagement positions wherein a corresponding pawl is rotated into position to engage a corresponding print wheel ratchet wheel. A rotatable reset lever is also mounted on the trigger unit casing for the purpose of returning the selective pawls to a print wheel disengagement position. The selective pawls and the reset lever are both supported on the trigger unit casing in a prealigned relationship and support means are provided on the main housing frame for supporting the set of print wheels. Interengagement means on the trigger unit casing and the main housing frame provide for securing the casing onto the main housing frame whereby positional alignment of the casing selective pawls relative to the print wheel ratchet wheels is achieved without need for any further after-assembly adjustment.

Supporting members for supporting the selective pawls and reset lever are constructed and assembled as a single unitary unit in the printer unit casing and the unit casing is positioned on the printer main frame via preformed alignment means. Also, the positioning member of print wheels, which determine the print wheel position along the print wheel support shaft is constructed as a unitary unit in the printer unit casing. Further, beam shaped members are provided on opposite ends of the reset lever and have engaging portions at the lower end of the beams that are releasably secured with engaging portions provided on the printer trigger unit casing to attach the reset lever to the casing in a manner that it will not disengage from the latter when once assembled.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
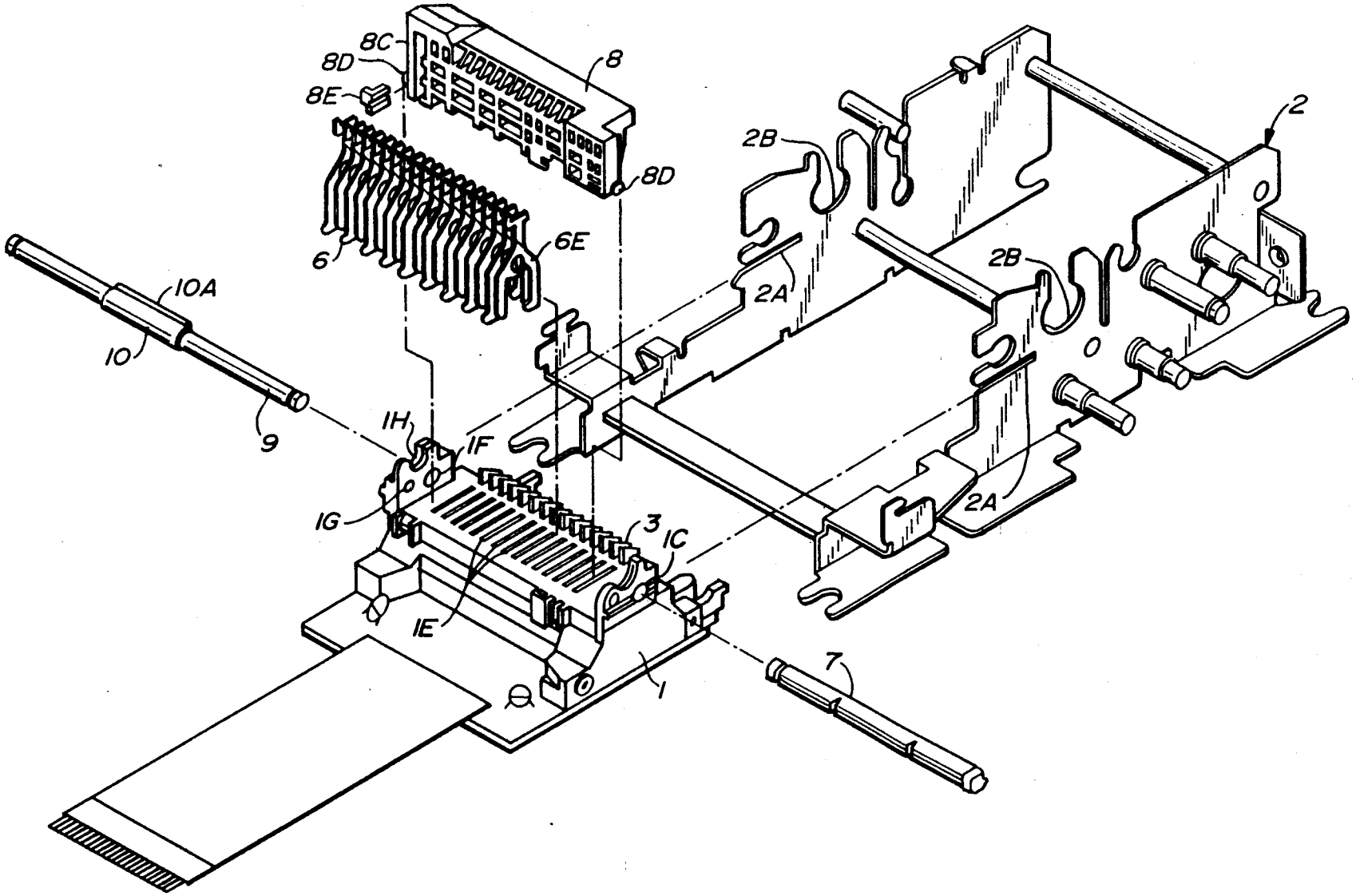
FIG. 1 is an exploded illustration of the key components of a disassembled print wheel printer comprising this invention.
Figure 2:
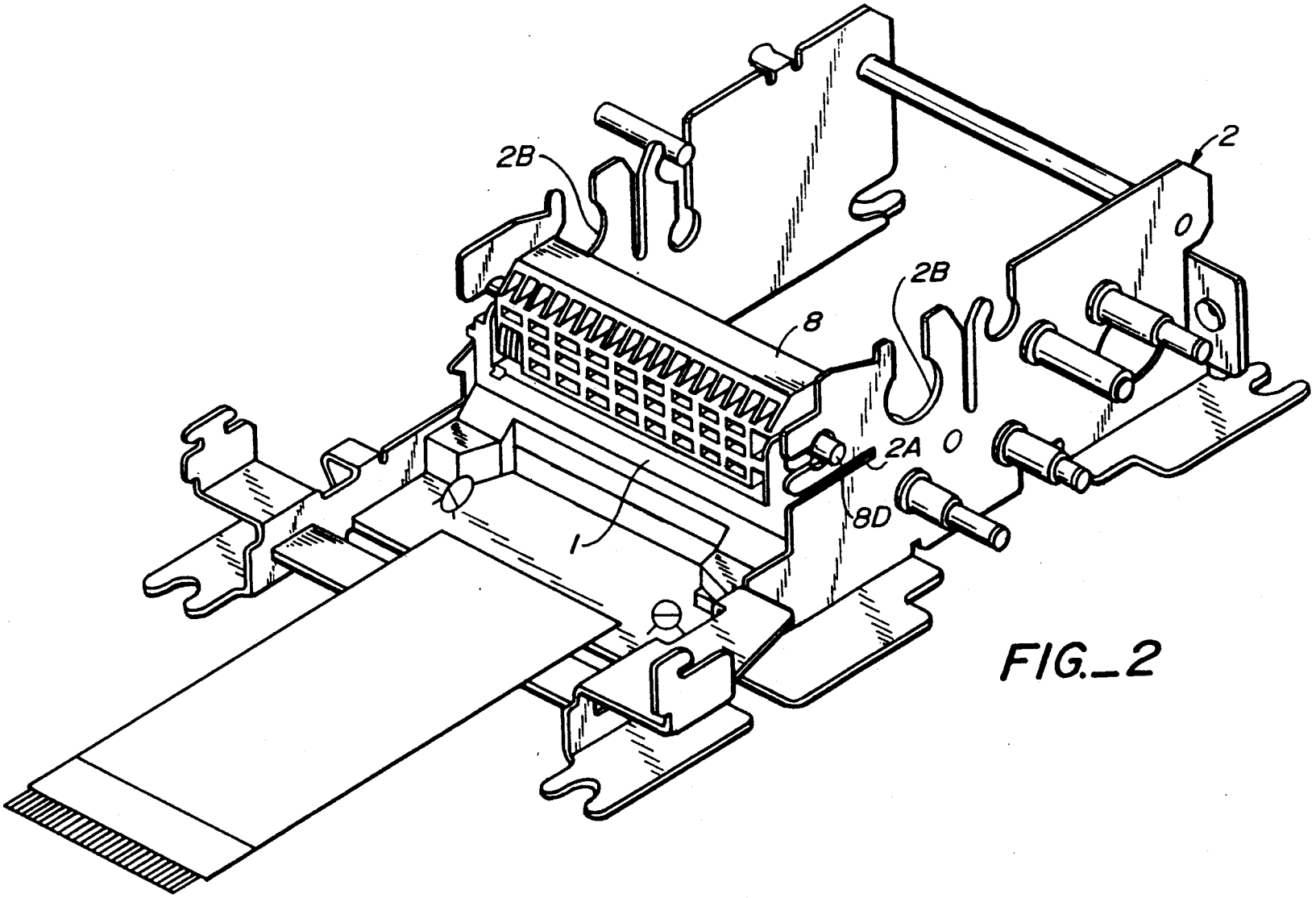
FIG. 2 is a perspective illustration of the key components of FIG. 1 in assembled form.

Reference is now made to FIGS. 1 and 2 wherein there is illustrated disassembled and assemble key components of a print wheel printer comprising this invention. These printer components comprise trigger unit casing 1, main housing frame 2, selective pawls 6, pawl shaft 7, reset lever 8, reset cam shaft 9 and reset cam 10 on shaft 9. As illustrated relative to FIGS. 1, 2 and 3, trigger unit casing 1 is positioned on main housing frame 2 via horizontal positioning slots 2A which also are guides for positioning and precision alignment of casing 1 relative to housing 2. As shown in FIG. 4, print wheels 11 are supported on print wheel shaft 13. Print wheel shaft 13 is supported in upwardly open shaft slots 2B on main housing frame 2. The positioning of trigger casing 1 relative to the supported positions of print wheels 11 is accurately determined by print wheel shaft 13 as fixed in aligned apertures 2B as best illustrated in FIG. 4.

Figure 3:
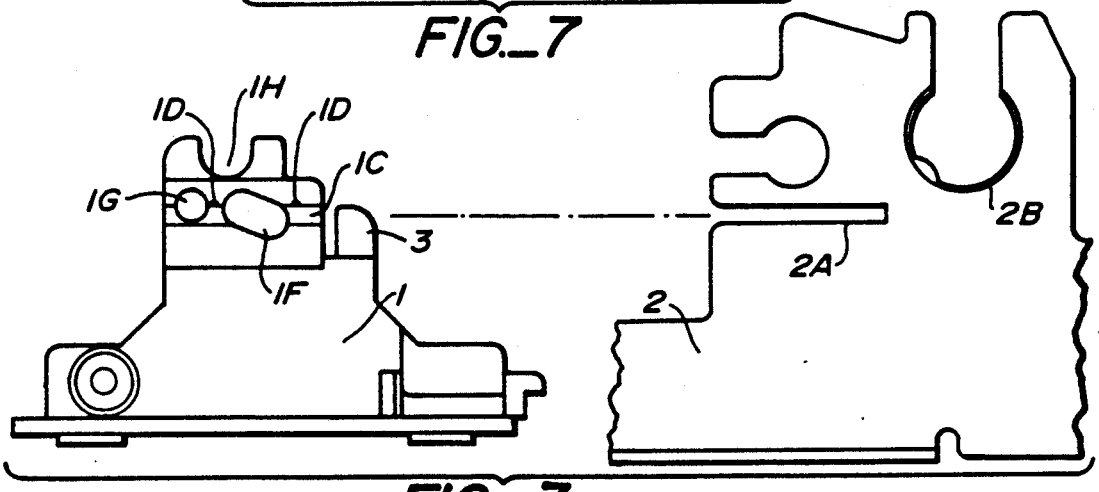
FIG. 3 is a side view of the trigger unit casing and the main housing frame.
Figure 4:
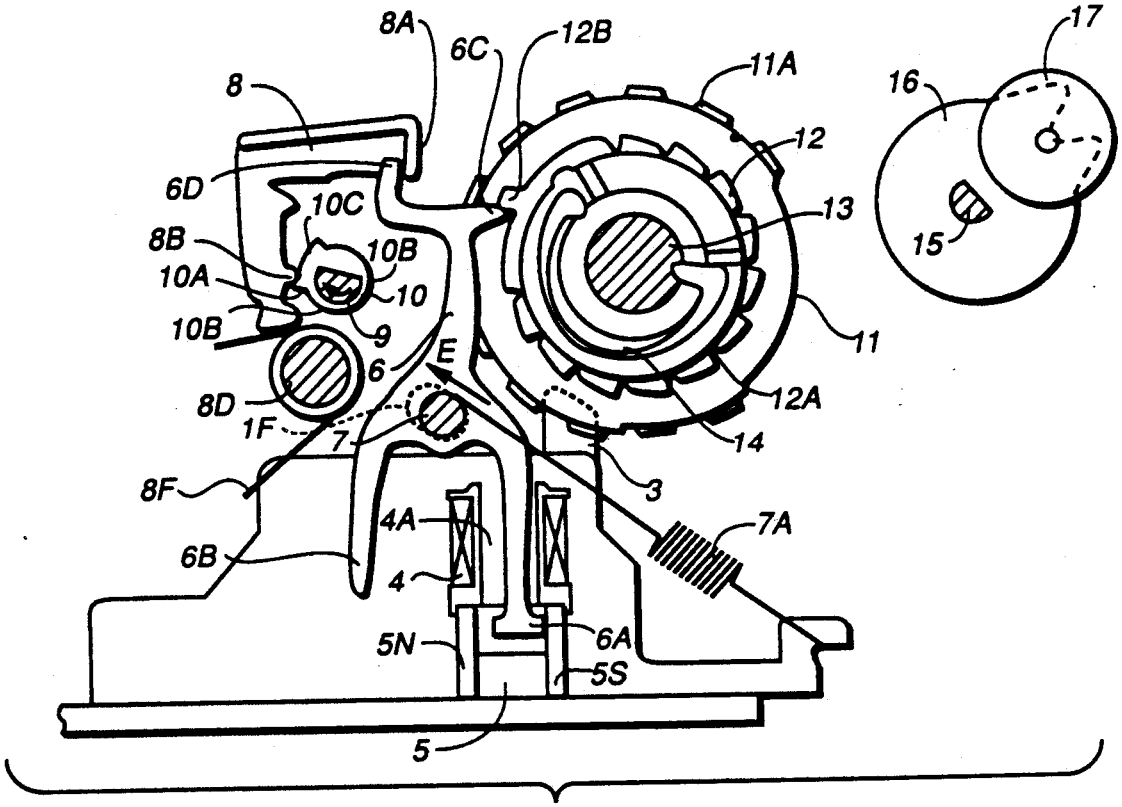
FIG. 4 is side elevation of the operating structure of the print wheel printer.

As shown in FIGS. 1 and 3, trigger unit casing 1 has outwardly projected guides 1C on the upper portion of both sides of the frame of casing 1 and guides 1C extend on either side of elongated aperture 1F, i.e., projected guides 1C are of extended length in the direction of installation of trigger unit casing 1 into frame 2 with aperture 1F intervening between extended portions of guides 1C. Projected guides 1C slide into horizontal positioning slots 2A, as illustrated in FIG. 3. Projected guides 1C accurately determine transverse positioning of trigger casing 1 within the inner end of horizontal positioning slots 2A of frame 2 and determine vertical positioning of casing 1 within frame 2 relative to the height of horizontal positioning slots 2A on frame 2. As shown in FIG. 3, there are two or more projections 1D on the upper surfaces of guides 1C to insure a secure and tight fit of casing 1 on housing 2.

Figure 5:
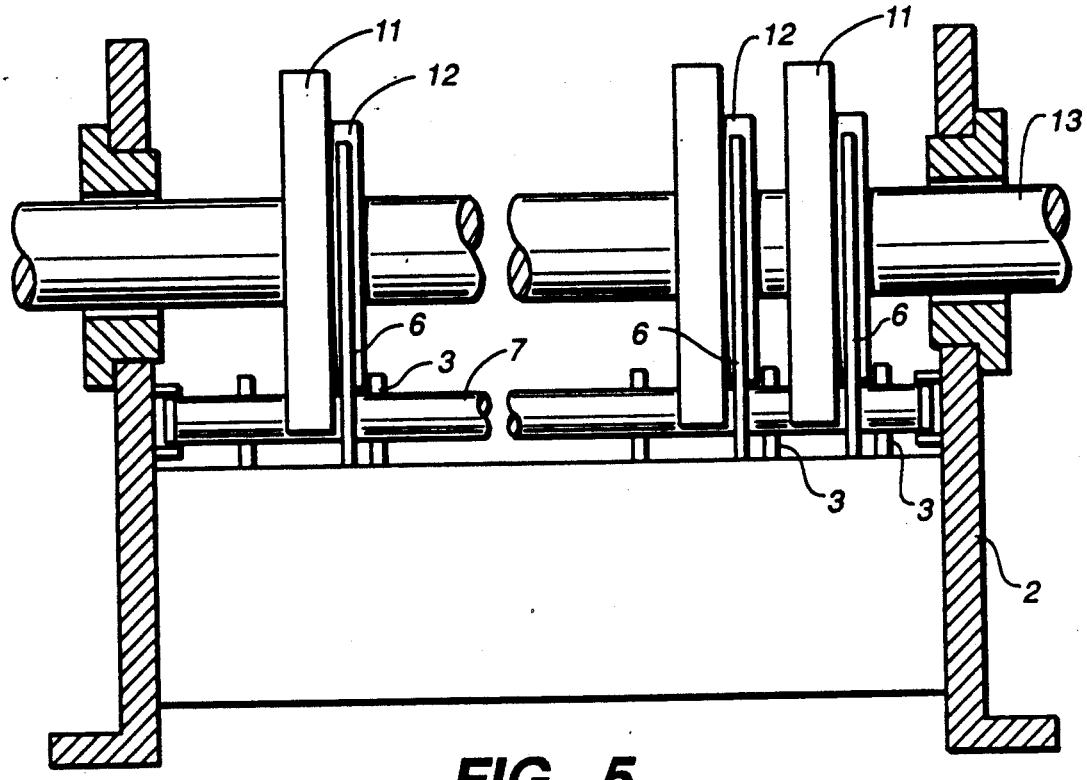
FIG. 5 is a front elevation of the print wheel printer.

FIGS. 4 and 5 illustrate the key operating components of the print wheel printer of this invention. Trigger unit casing 1 comprises trigger coil 4, permanent magnet 5 and a plurality of print wheel position determining members 3 which protrude along adjacent sides of print wheels 11. At both sides of the upper portion of casing 1 are elongated apertures 1F for supporting selective pawl shaft 7. Selective pawls 6 are rotatably mounted on selective pawl shaft 7. Selective pawl shaft 7 is supported in elongated apertures 1F in a manner wherein selective pawl shaft 7 is biased toward print wheel 11 by means of coil spring 7A. Apertures 1G in FIG. 1 support reset lever shaft 8D and upwardly open apertures 1H support reset cam shaft 9. At the end of trigger unit casing 1 corresponding to the closest proximity to print wheels 11 after assemblage, there are a plurality of print wheel positioning members 3 extending at spaced intervals between adjacent print wheels 11 and determine the positional relationship of print wheels 11 along shaft 13 upon assembling of casing 1 to frame 2.

As it can be seen in FIG. 1, there are a plurality of aligned rectangular apertures 1E formed in the upper surface of trigger unit casing 1 into which are inserted and supported two lower legs 6A and 6B of each selective pawl 6. This inserted positioning is best seen in FIG. 4. A trigger coil 4 is positioned in a lower portion of each rectangular aperture 1E. Below each trigger coil 4 are positioned a magnetic coil 5 aligned perpendicular relative to pawl shaft 7. Two pole plates 5N and 5S are secured on opposite magnetic poles of each permanent magnet 5 and function to magnetically draw selective pawl leg 6A and rotate the bottom end portion of selective pawl leg 6A. In this connection, leg 6A extends through hollow core portion 4A of trigger coil 4. One of the two upper legs 6C and 6D of each selective pawl 6, i.e., leg or extension 6C, becomes engaged with one of the grooves or notches 12A of ratchet wheel 12. Ratchet wheel 12 is secured to one side of each print wheel 11. The engagement of pawl extension 6C engages a notch 12A which positions one of characters 11A on the periphery of print wheel 11 to be aligned in proper printing position. When pawl notch 6C becomes engaged with notch 12A of ratchet wheel 12, the positive going edge leg 6D which becomes engaged with hitching pawl 8A of reset lever 8.

Reset lever 8 is operated by reset cam 10 so that selective pawls 6 rotate between two different positions, a print wheel engaging position and a print wheel disengaging position. Hitching pawl 8A at the upper end of lever 8 is an elongated member widthwise relative to the printer so that all selective pawls 6 can be returned concurrently to the print wheel disengaging position. Projection 8B on reset lever 8 is engaged by respective cam portions 10C and 10A of reset cam 10 when cam 10 is rotated on shaft 9.

Figure 6:
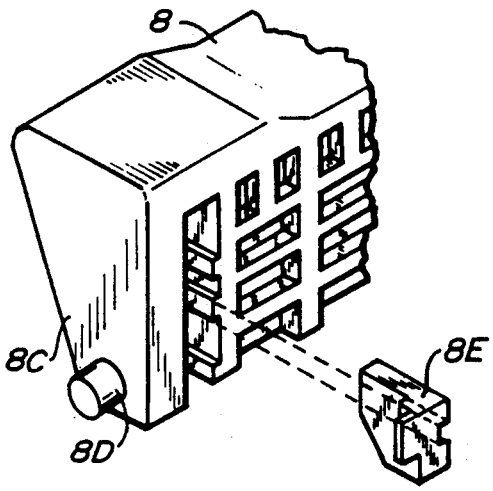
FIG. 6 is an enlarged perspective view of a key component of the reset lever of the print wheel printer.

As best illustrated in FIG. 6, along adjacent sides of reset lever 8 next to inner main housing frame 2 are beam shaped members 8C which are integral to one end of lever 8. At the lower end of each member 8C is outwardly extended shaft 8D. Shafts 8D are inserted into reset lever shaft support apertures 1G positioned at the upper portion of trigger unit casing 1, as shown in FIG. 1. Wedge member 8E is then inserted between beam shaped member 8C and the body of lever 8 in order to prevent the disengagement of lever 8 from apertures 1G after its installation on casing 1.

Figure 8:
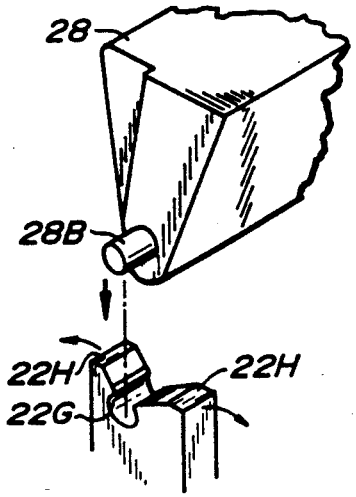
FIGS. 7 and 8 are perspective illustrations of means by which a reset lever is installed in the print wheel printer.
Figure 7:
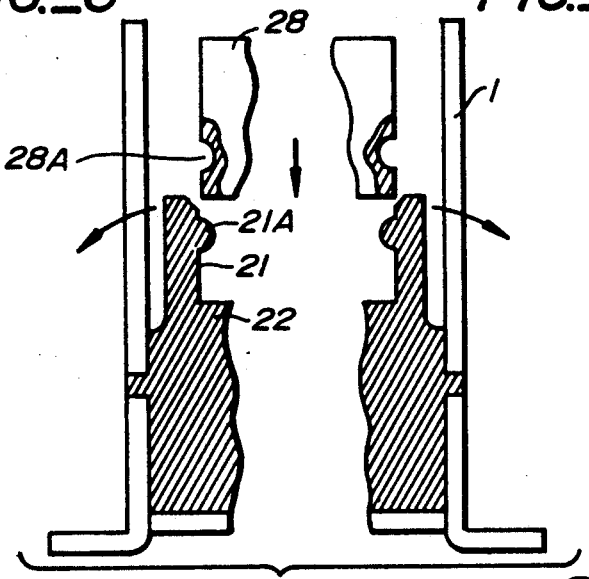

FIGS. 7 and 8 illustrate two other embodiments for installation of reset lever 8 relative to casing 1. As shown in FIG. 7, flexible member 22 is supported relative on trigger unit casing 1. Upper extended flexible portions 21 of member 22 are easily flexed, as indicated by the arrows in FIG. 7, and projections 21A formed near the top ends of flexible members 21 are engaged with corresponding recesses 28A formed in adjacent lower side portions of reset lever 28.

In the case of FIG. 8, shaft portions 28B of reset lever 28 become securely engaged within W shaped reset lever shaft support slots 22G of trigger unit casing 22. The upper ends of slot extensions 22H are flexible and separate to permit the retention of shaft portions 28B.

As previously indicated, reset lever 8 is driven by the rotation of reset cam 10 via shift 9. As shown in FIG. 1H, reset cam shaft 9 is supported in upwardly open slots 1 at the top of trigger unit casing 1, i.e., at the vertex of a triangle formed by apertures 1F, 1G and 1H wherein apertures 1F and apertures 1G are at the base of the triangle.

Assembly of the key components of the print wheel printer is as follows. First, a plurality of selective pawls 6 corresponding to the number of print wheels 11 are inserted into rectangular apertures 1E located at the top of trigger unit casing 1. Next, selective pawls 6 are installed by inserting selective pawl shaft 7 through holes 6E in each of the pawls 6 by first inserting shaft 7 from one side of trigger unit casing 1 into casing elongated aperture 1F and thence through center holes 6E of each selective pawl 6 and thereafter through the other casing elongated aperture 1F at the other side of trigger unit casing 1.

Next, reset cam shaft 9 is positioned in upwardly open slots 1H at the top of trigger unit casing 1. Further, projected shaft portions 8D, located at the lower ends of each side of reset lever beam member 8C are set into shaft apertures 1G from within trigger unit casing 1. During the course of this insertion, beam shaped members 8C are bent slightly inward to accommodate the placement of shaft portions 8D into apertures 1G. Print wheel positioning members 3 and all the moving members for selecting characters are then assembled relative to trigger unit casing 1 as a single unitary unit.

Next, assembled trigger unit casing 1 is positioned and fixed accurately both in transverse and vertical directions by inserting horizontal projection guides 1C located on adjacent sides of trigger unit casing 1 into horizontal positioning slots 2A of main housing frame 2 and casing 1 is pushed into housing frame 2 until the forward end of projected guides 1C reach the end of slots 2A. Thus, a plurality of print wheel positioning members 3 located at the edge of trigger unit casing 1 are accurately positioned between respective print wheels 11 thereby determinative of the aligned location of each rotatably mounted print wheel 11 in the printer as well as their uniform spatial relation along print wheel shaft 13.

Figure 9:
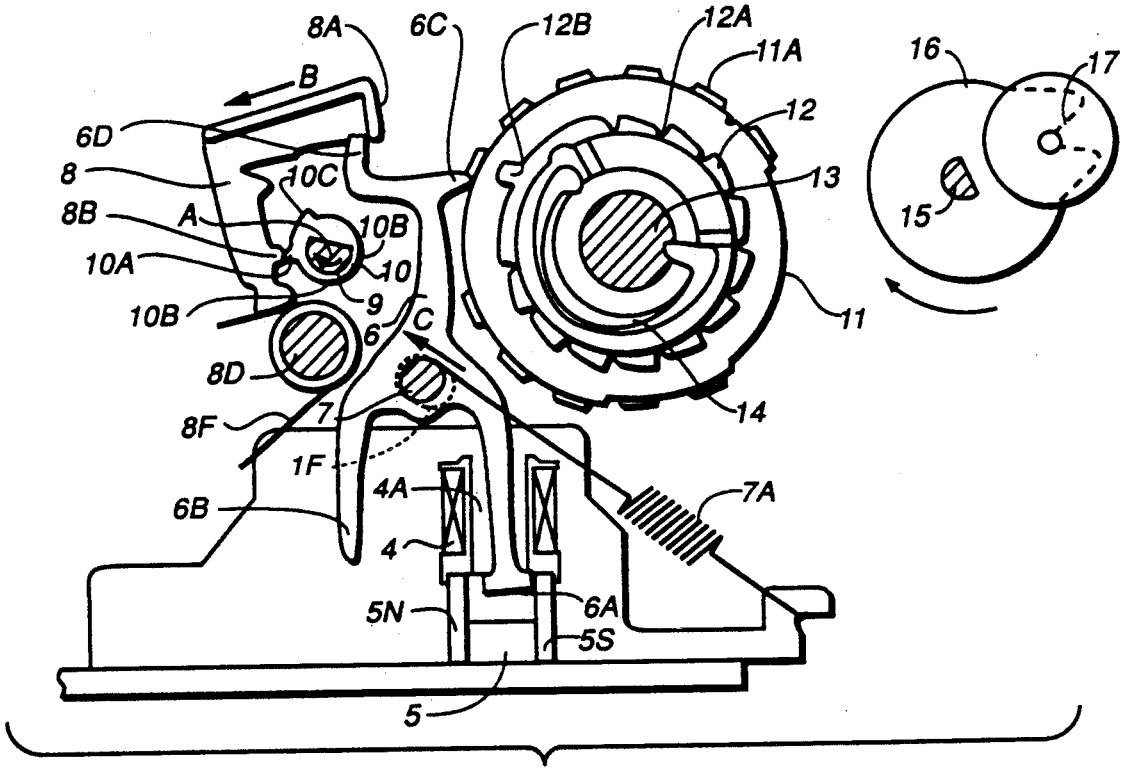
FIGS. 9 through 12 are a series of side elevations of the print wheel printer illustrating the printing action of the printer.

The functional operation of the print wheel printer is as follows. First, as shown in FIG. 9, when reset cam 10 rotates in the direction indicated by arrow A, reset lever 8 rotates in the direction indicated by arrow B due to engagement of projection 10A with lever projection 8B. As a result, all selective pawls 6 together with selective pawl shaft 7 are move in a direction indicated by arrow C due to the pulling action of hitching pawl 8A on pawl legs 6D. Thus, pawl extensions 6C are all disengaged from projections 12B of ratchet 12 thereby permitting free rotational movement of respective print wheels 11 on shaft 13.

Figure 10:
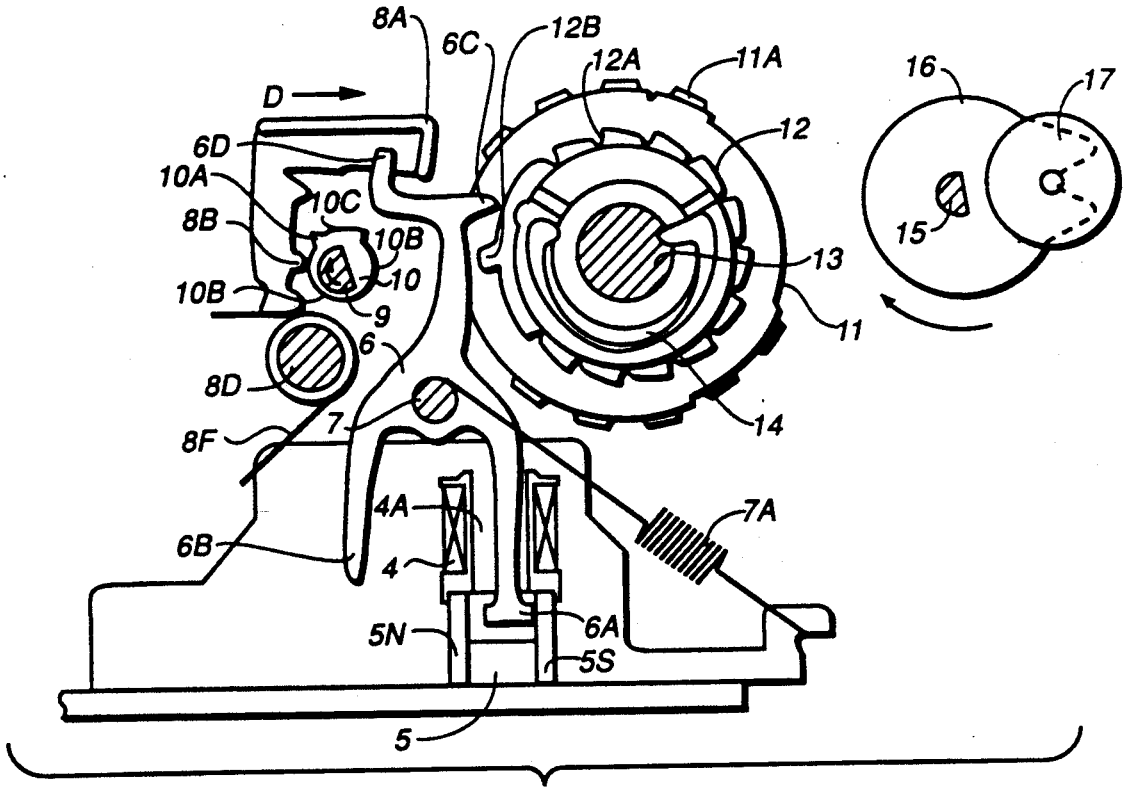

As reset cam 10 continues in its path of rotation in the direction of arrow A, reset lever projection 8B drops to a small diameter cam portion 10B of cam 10 and, as a result, lever 8 moves in the direction indicated by arrow D, as shown in FIG. 10, due to the force reset lever spring 8F. As a result, all selective pawls 6 are freed from hitching pawl 8A of lever 8 and are now set free to rotate about shaft 7.

Figure 11:
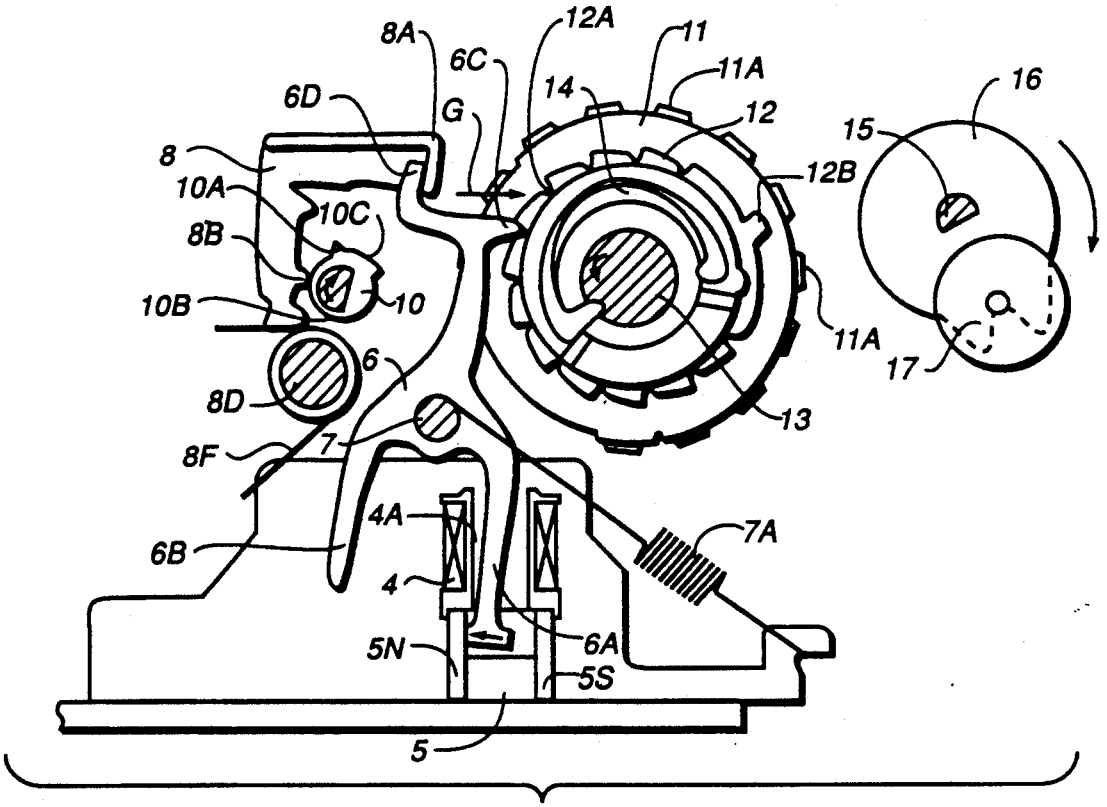
Figure 12:
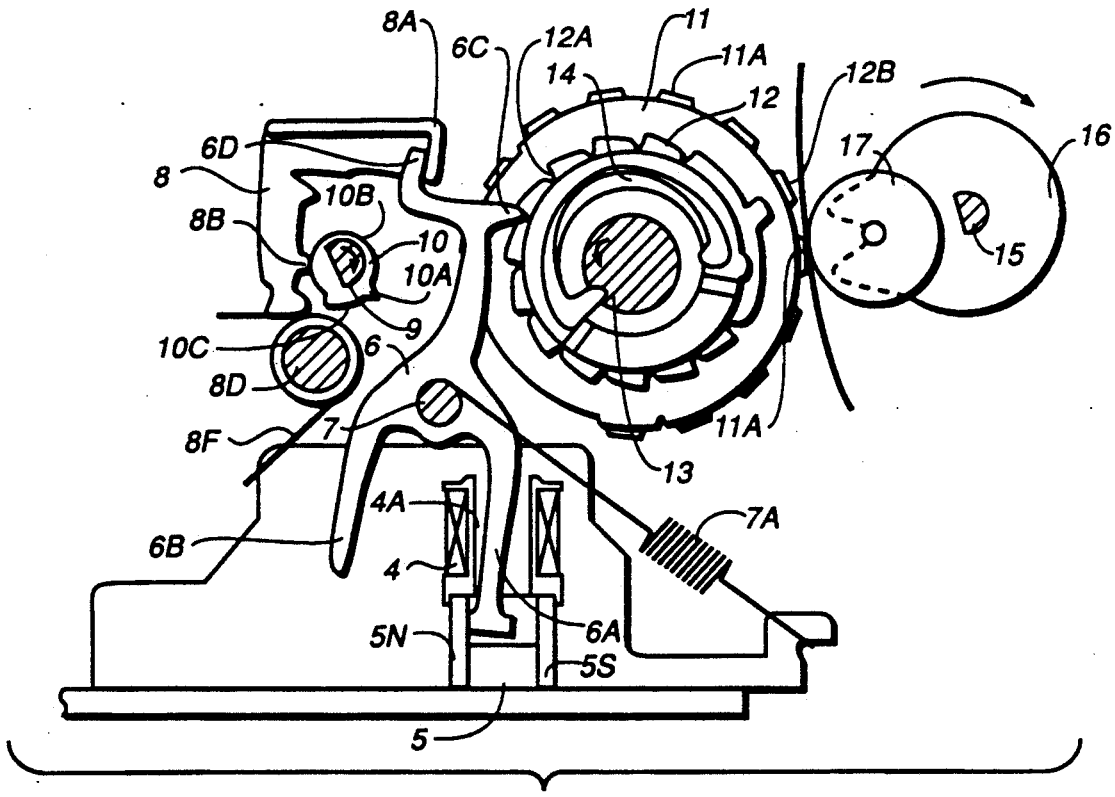

In this condition, when a voltage is applied to a selected trigger coil 4 of a corresponding selective pawl 6, leg 6A of the selected pawl 6 is magnetically repelled by magnetic pole plate 5S and drawn to magnetic pole plate 5N, as illustrated in FIG. 11. As a result, the selected pawl 6 is rotated in the direction of arrow G about shaft 7. At this time, pawl extension 6C of the selected pawl will become engaged with a corresponding notch 12A of rotating ratchet wheel 12 thereby stopping the rotational motion of corresponding print wheel 11 secured to the stopped ratchet wheel 12. Also, at the same time, print wheel spring 14 comes out of the groove of print wheel shaft 13 allowing print wheel shaft 13 to continue to rotate while the selected print wheel 11 is stopped at its selected position. Thus, a selected character 11A on the periphery of print wheel 11 is placed in a selected printing position. Printing roller 17 is supported by printing roller support 16 secured on printing shaft 15 and upon rotation brings about pressure engagement of recording medium S from the back surface thereof and printing is performed on the front surface of medium S, as illustrated in FIG. 12. When this printing action is completed, reset cam 10 has rotated one complete cycle and reset lever 8, due to engagement cam portion 10C by lever projection 8D, is rotated in a counterclockwise direction, i.e., in the direction indicated by arrow B in FIG. 10. As a result, all selective pawls 6 are again rotated and laterally moved on shaft 7 by lever hitching pawl 8A in the direction indicated by arrow C in FIG. 9. Thus, all pawl extensions 6C engaged with ratchet wheel notches 12A become disengaged from these notches 12A and pawl extensions 6C become engaged with projections 12B of ratchet wheels 12 to reset each of print wheels 11.

While the invention has been described in conjunction with several specific embodiments, it is evident to those skilled in the art that many further alternatives, modifications and variations will be apparent in light of the forgoing description. Thus, the invention described herein is intended to embrace at such alternatives, modifications, applications and variations as fall within the spirit and scope of the appended claims.

What is claimed is:

1. A print wheel printer comprising a trigger unit casing and a main housing frame, a plurality of print wheels rotatably mounted on a print wheel shaft and having a corresponding ratchet wheel secured to one side of each of said print wheels, a plurality of rotatably mounted selective pawls supported on said casing for stopping the rotation of said print wheels at selected print wheel engagement positions wherein a corresponding pawl is rotated into position to engage a corresponding ratchet wheel, a rotatable reset lever supported on said casing to return said selective pawls to a print wheel disengagement position, said selective pawls and said reset lever supported on said casing in a prealigned relationship, means on said main housing frame for supporting said print wheels, and interengagement means on said casing and said main housing frame for securing said casing onto said main housing frame whereby positional alignment of said casing selective pawls relative to said housing print wheel ratchet wheels is achieved without need for further after assembly adjustment.

2. The print wheel printer of claim 1 further including a plurality of projected positioning members on said casing, each of said positioning members extending between adjacently positioned print wheels for spatially aligning said print wheels uniformly along said print wheel shaft when said casing and said frame are assembled via said interengagement means.

3. The print wheel printer of claim 1 further including longitudinally extended, elongated projection guides on opposite sides of said trigger unit casing for fitting into corresponding open ended positioning slots on said main housing frame.

4. The print wheel printer of claim 1 having means for supporting a selective pawl shaft, a reset lever shaft, and a reset cam shaft as a unitary unit on said trigger unit casing.

5. The print wheel printer of any one of the claims 1 through 4 further including downwardly disposed engaging means at opposite ends of said reset lever, corresponding engaging means on said trigger unit casing and releasable securing means for retaining said reset lever engaging means in engagement with trigger unit casing engaging means.

* * * * *